United States Patent [19]

Bowyer

[11] 4,406,325

[45] Sep. 27, 1983

[54] SELECTIVE NO-GO APPARATUS

[75] Inventor: Michael L. Bowyer, Aberdeen, Scotland

[73] Assignee: Baker International Corporation, Orange, Calif.

[21] Appl. No.: 307,909

[22] Filed: Oct. 2, 1981

[51] Int. Cl.[3] ..... E21B 23/02

[52] U.S. Cl. ..... 166/214; 166/217; 166/237; 166/381

[58] Field of Search ..... 166/317, 321, 322, 323, 166/332, 334, 214, 217, 237, 243, 381

[56] References Cited

U.S. PATENT DOCUMENTS

| | | | |
|---|---|---|---|
| Re. 25,289 | 11/1962 | Fredd | 166/214 |
| 3,472,530 | 10/1969 | Fowler | 166/217 X |
| 3,568,770 | 3/1971 | Fredd | 166/217 X |
| 3,893,717 | 7/1975 | Nelson | 166/217 |
| 3,912,009 | 10/1975 | Davis, Jr. | 166/243 X |
| 3,918,747 | 11/1975 | Putch | 166/217 |
| 4,005,751 | 2/1977 | Page, Jr. | 166/321 |
| 4,167,970 | 9/1979 | Cowan | 166/214 |
| 4,276,932 | 7/1981 | Saliges et al. | 166/214 |

*Primary Examiner*—Stephen J. Novosad
*Assistant Examiner*—Joseph Falk
*Attorney, Agent, or Firm*—Norvell & Associates

[57] ABSTRACT

A no-go apparatus for positioning a tool within a landing nipple in a tubing string in a subterranean well includes a mandrel axially movable within the tubing string having selectively radially expandable latches for engaging a specially shaped annular groove formed on the inside cylindrical surface of the landing nipple, thereby preventing downward movement of the latches and mandrel past the groove. The latches are configured to prevent their engagement by any groove or projections in the tubing string other than the correspondingly shaped groove.

7 Claims, 2 Drawing Figures

SELECTIVE NO-GO APPARATUS

BACKGROUND OF THE INVENTION

1. Field of the Invention

The invention relates to a no-go system for interfering with the downward movement of a tool, such as a safety valve, past a particular point in a landing nipple in a subterranean well, thereby accurately positioning the valve in the desired location.

2. Description of the Prior Art

No-go shoulders are used to positively position a device, such as a valve, within a landing nipple, for example. Known no-go systems comprise an integral, annular shoulder inwardly projecting from the inside cylindrical surface of a landing nipple. The inside diameter of the no-go shoulder is large enough to permit passage of necessary wire line tools, but small enough to interfere with an outwardly projecting no-go shoulder formed on a safety valve, or other tool to be positioned by the no-go system.

Such conventional systems accurately position a tool in a landing nipple, and also provide contact surfaces for transmission of jarring forces. However, in the prior art, design compromises have been necessary. On one hand, the no-go shoulder on the nipple must be small enough to permit tools to bypass it, and to present minimum restrictions to production flow. On the other hand, the shoulder must be large enough to effectively interfere with the downward movement of the valve or other tools to be positioned, and to sustain large jarring forces. Inwardly projecting no-go shoulders as described are subject to wear caused by wire line tools passing across the shoulder when the valve is out of position, as during operations for running and retrieving other valves or plugs. In some instances, the inwardly projecting shoulders have been worn to the extent that they have failed to resist downward movement of the valve during downward jarring, thereby permitting the valve to become jammed in the no-go shoulder.

SUMMARY OF THE INVENTION

A no-go system according to the invention includes a landing nipple having an annular groove, or landing profile formed in its inside cylindrical surface. The groove is recessed from the inside cylindrical surface of the nipple and from the inner surface of the tubular conduit or tubing string having a prescribed diameter, and hence presents no restrictions to production flow, or to passage of normal wire line tools.

The tool, such as a safety valve, cooperating with the landing nipple and latch groove includes a mandrel on which a latch collet is axially slidably mounted. The collet has resilient, upwardly extending latch fingers engagable with the latch groove. As the mandrel is run in downwardly towards the landing nipple, the latch fingers are in a retracted position within an annular groove formed on the outside surface of the mandrel. The latch fingers are held in this recessed position against their outward bias by the inside surface of the tubing through which the mandrel and valve are moving. As the latch fingers are moved interiorly adjacent the latch groove in the landing nipple, they are freed to spring outwardly from the recess into engagement with the latch groove. After the latch fingers have moved outwardly from the recess into the latch groove, the valve mandrel continues to move downwardly until a downwardly facing shoulder thereon contacts the upper surfaces of the latch fingers, thereby making a no-go contact and preventing further downward movement.

The latch fingers are configured to prevent their engagement in any groove or obstruction other than the corresponding profile of the latch groove.

When the valve is retrieved, the mandrel slides upwardly relative to the latch collet, until the recess is again opposite the heads of the latch fingers. As the valve continues upwardly, the latch fingers are cammed inwardly to their retracted position within the recess, permitting the valve to be removed normally. Means normally above the described apparatus prevents upwards disengagement of the device from the nipple during normal operation.

DESCRIPTION OF THE PREFERRED EMBODIMENTS

Figure 1:
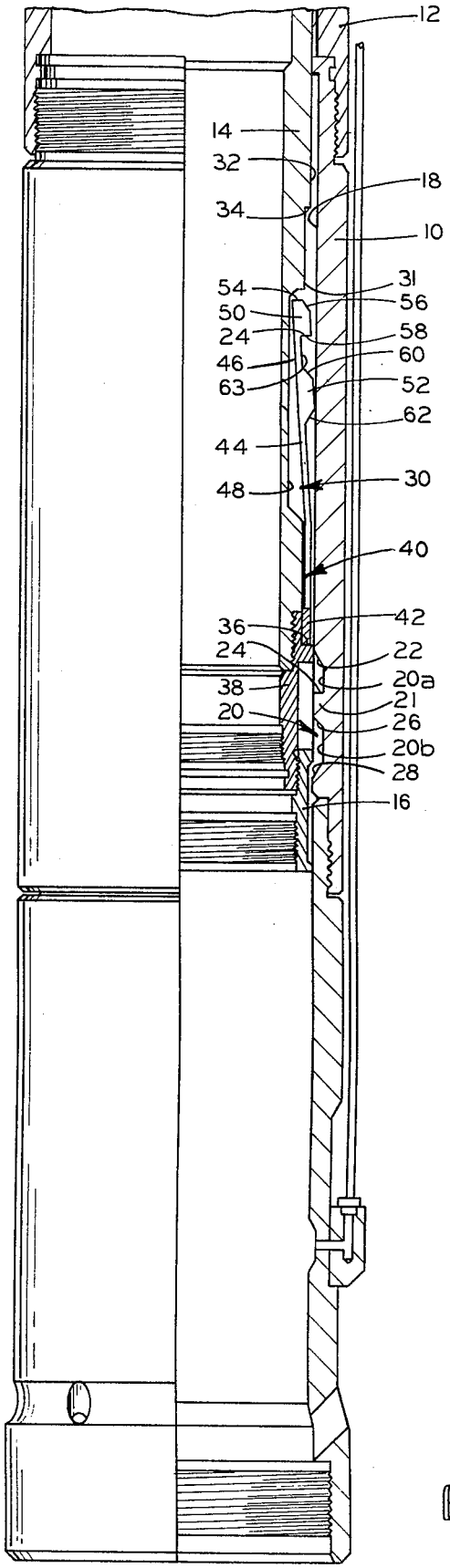
FIG. 1 is an elevational view, in half section, of a landing nipple and a mandrel of a wire line tool, incorporating the selective no-go of the invention, the latch fingers being in their retracted position as they approach the latch groove.

Referring to FIG. 1, a landing nipple 10 embodying the selective no-go of the invention is part of a tubing string 12.

An annular mandrel 14 embodying the selective no-go is part of a tool, such as a safety valve assembly (not illustrated) being run into position in the landing nipple 10. The safety valve assembly, or other tool to be positioned, would be secured to the mandrel 14 by the threaded connector sleeve 16 and is operable within the tubular conduit at a location having a prescribed diameter less than the diameter of the no-go nipple. Operation of the valve means or other tool means (not shown) generally requires that sealing integrity be established below the nipple.

Unlike conventional nipples having no-go shoulders, the landing nipple 10 has no inward projection from its inside cylindrical surface 18 to restrict flow, or to interfere with passage of wire line tools. As part of the selective no-go system, the landing nipple 10 includes a latch groove 20.

The latch groove 20 comprises an upper groove **20*a*, and a lower groove 20*b*, separated by an annular inward projection 21 of the same internal diameter as the bore 18 of the nipple 10. The upper groove 20*a* is defined by an upper camming surface 22 which tapers downwardly and outwardly from the cylindrical surface 18 of the landing nipple 10. The lower limit of the groove 20*a* is defined by a jarring surface 24** in a substantially radial plane but which preferrably tapers inwardly and slightly downwardly.

The lower groove **20*b* is defined by an upper annular camming surface 26 of the annular projection 21, which tapers downwardly and inwardly, and by a lower annular camming surface 28 which tapers inwardly and upwardly from the cylindrical surface 18**.

The mandrel 14 includes an annular latch collet recess 30 formed in its outside cylindrical surface 32. The upper limit of the recess is defined by a downwardly facing annular shoulder 34, and the lower limit of the recess 30 is defined by an upwardly facing annular shoulder 36 of a connector sleeve 38.

A latch collet 40 is slidably mounted within the latch collet recess 30. The latch collet 40 includes a lower annular ring 42, and a plurality of circumferentially spaced, upwardly extending resilient latch fingers 44.

The latch fingers 44 terminate at their upper ends in latch heads 46 shaped to engage the latch groove 20. As illustrated in FIG. 1, as the mandrel 14 is being run downwardly into the landing nipple 10, the latch fingers are in a retracted position within an inner annular latch finger recess 48 formed within the annular collet recess 30. The latch fingers 44 are resiliently biased outwardly, but are retained in the retracted position within the inner recess 48 by the inside cylindrical surface 18 of the nipple 10.

Each latch head 46 includes an outwardly projecting upper no-go projection 50 and an outwardly projecting lower camming projection 52. Each no-go projection 50 is defined by an upwardly facing shoulder 54, an outwardly and downwardly tapering camming surface 56, and an inwardly and slightly upwardly tapering surface 58. Each lower camming projection 52 includes an upper downwardly and outwardly tapering surface 60 and a lower, downwardly and inwardly tapering surface 62. Thus a groove 63 is defined in each latch head 46 between the surfaces 58 and 60.

The lower camming surfaces 62 prevent the latch shoulders 58 from engaging any groove other than the latch groove 20. The camming surfaces 62 will cam the latch finger heads 46 inwardly past any groove having an axial extent less than that of the latch groove 20. Any groove with a radial depth less than that of the latch groove 20 will not permit the heads 46 to spring outwardly beyond the inner recess. The camming surface 62 extends radially outwardly beyond the latch shoulder 58, preventing the engagement of the latch shoulder 58 with such groove. Hence, the camming surfaces 62 will return the heads 46 to their fully retracted position within the inner recess 48 as the mandrel 14 moves downwardly past such groove.

Figure 2:
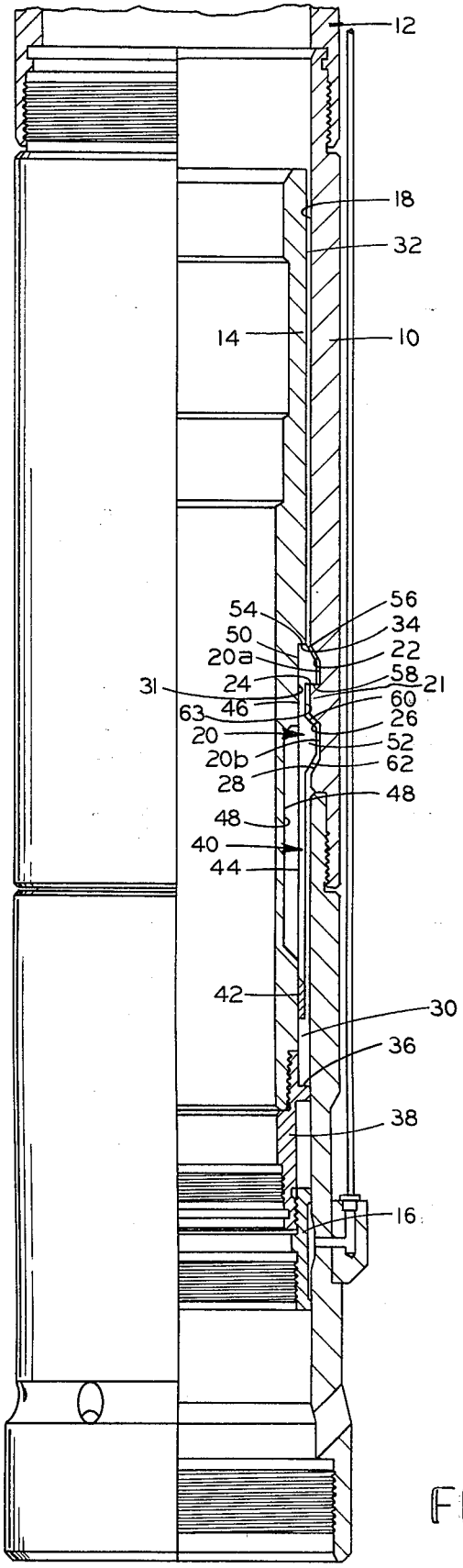
FIG. 2 is a view similar to FIG. 1, showing the latch fingers in engaged relationship with the latch groove, and presenting a no-go shoulder to prevent further downward movement of the mandrel.

During downward movement of the mandrel 14, as the latch heads 46 become aligned with the latch groove 20, they spring outwardly from the inner recess 48 into the latch groove 20. As illustrated in FIG. 2, the correspondingly shaped latch groove 20 receives the lower camming projections 52 within the lower groove **20*b*, and the upper no-go projections 50 of the latch heads 46 within the upper groove 20*a*. The resultant engagement of the no-go shoulder 58 and the annular surface 24 prevents further downward movement of the latch collet 40 and prevents engagement of the camming surfaces 62 and 24. After the latch fingers 44 have thus expanded outwardly, the mandrel 14 is free to continue downward motion until its downwardly facing shoulder means 34 defining the top of the recess 30 abuts the upper no-go shoulders 54 of the latch heads 46. In this position, the annular surface 31 also comprising part of the shoulder means on the periphery of the inner mandrel abuts the latch fingers 44 and prevents their retraction from the groove 20**.

The engagement of the shoulder 34 and the no-go surfaces 54 provides positive positioning of the mandrel 14 within the landing nipple 10. Downward jarring forces can be transmitted through the shoulder 34 to the no-go shoulders 54, through the upper no-go projections 50 of the heads 46 and the downwardly facing shoulders 58, to the upwardly facing annular jarring surface 24 of the upper groove **20*a*. These abutting surfaces 24 and 58 are outwardly recessed from the cylindrical surface 18** and out of the flow path. Hence, they can be made larger than conventional no-go shoulders to withstand jarring forces, without interfering with tool passage or fluid flow.

When the mandrel 14 and the valve assembly 16 is to be removed, upward movement of the mandrel 14 will bring the upwardly facing shoulder 36 of the connector sleeve 38 in contact with the latch collet annulus 42, and the latch heads 46 opposite the latch head recess 48. Thereupon, continued upward movement of the mandrel 14 will cause the latch fingers to be cammed into retracted positon within the recess 48, by the action of the camming surfaces 22 and 26 of the latch groove 20 on the camming surfaces 56 and 60 of the latch heads 46.

The no-go apparatus described allows accurate positioning of a tool in a subterranean well by providing the vertically spaced latch projections 50 and 52 which are engagable only in the cooperating grooves **20*a* and 20*b* in the nipple 10. The latch is therefore selectively effective only when the latch head projections 50 and 52 are aligned with the vertically spaced grooves 20*a* and 20*b***.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A no-go apparatus for positioning a tool at a desired location within an associated nipple in a tubular conduit in a subterranean well by preventing downward movement past the desired location, comprising; an annular landing nipple within the tubing string having a pair of vertically adjacent annular grooves formed on the inside cylindrical surface of said nipple; an annular mandrel, connectable to a work string for insertion in the tubing string; means on said mandrel for attaching the tool to be positioned; radially shiftable latch means on said mandrel resiliently urged into an expanded position in engagement with said annular grooves said latch means being axially shiftable relative to said mandrel, annular recess means on the periphery of said mandrel for receiving the latch means in a radially retracted position, said latch means being normally maintained in radially retracted position within said annular recess means by the inside bore surfaces of the tubing string and said nipple to permit movement of said mandrel and said latch means relative to said tubular string; a downwardly facing external shoulder on said mandrel spaced above said annular recess means, said shoulder being abutable with said latch means when said latch means is radially expanded; an annular surface on the periphery of said mandrel between said annular recess means and said downwardly facing shoulder, said latch means being positioned between said annular surface and at least one of said annular grooves when axially shifted into abutment with said downwardly facing shoulder; said latch means defining a pair of vertically adjacent radial projections contoured to simultaneously enter said annular grooves to oppose further downward displacement of said mandrel.

2. A no-go apparatus as defined in claim 1 wherein the lower one of said annular grooves has a downwardly in inwardly inclined bottom surface and said lower one of said radial projections has a correspondingly shaped bottom surface, thereby permitting said latching means to be cammed inwardly to pass any upwardly facing surfaces in the tubing string.

3. A no-go apparatus as defined in claim 2 wherein the upper one of said annular grooves has its bottom surface disposed in a substantially radial plane, and the bottom surface of the upper one of said radial projections has a correspondingly shaped bottom surface, thereby preventing further downward movement of said mandrel when said radial projections engage said annular grooves.

4. A no-go apparatus as defined in claim 3 wherein the upper one of said radial projections has a downwardly and outwardly inclined top surface, thereby permitting withdrawal of said mandrel from the tubing string.

5. The apparatus defined in claims 1, 2, 3 or 4 wherein said latch means comprises a collet axially slidably mounted on the outside surface of said mandrel, said collet including an annulus and resilient latch fingers extending axially upwardly from said annulus, said latch fingers having said radial projections formed on the free ends thereof, and means on said mandrel for limiting axial movement of said collet relative to said mandrel.

6. A no-go apparatus as defined in claims 1, 2, 3 or 4 wherein said latch means is mounted on said mandrel for limited axial movement, and said mandrel has an external surface axially movable into radially abutting relation with said latching means after said radial projections engage said annular grooves, thereby locking said radial projections in said annular grooves.

7. The apparatus defined in claims 1, 2, 3 or 4 wherein said latch means comprises a collet axially slidably mounted on the outside surface of said mandrel, said collet including an annulus and resilient latch fingers extending axially upwardly from said annulus, said latch fingers having said radial projections formed on the free ends thereof, means on said mandrel for limiting axial movement of said collet relative to said mandrel, said mandrel having an exterior cylindrical surface axially movable into radially abutting relation with said collet arms after said radial projections enter said annular grooves, thereby locking said radial projections in said annular grooves.

* * * * *